US008535763B2

(12) United States Patent
Inoue et al.

(10) Patent No.: US 8,535,763 B2
(45) Date of Patent: Sep. 17, 2013

(54) COATING METHOD AND COATING APPARATUS

(75) Inventors: Hiroyuki Inoue, Otsu (JP); Hiroshi Nagai, Otsu (JP); Naohiro Takashima, Otsu (JP)

(73) Assignee: Toray Industries, Inc., Tokyo (JP)

( * ) Notice: Subject to any disclaimer, the term of this patent is extended or adjusted under 35 U.S.C. 154(b) by 797 days.

(21) Appl. No.: 12/440,128

(22) PCT Filed: Aug. 31, 2007

(86) PCT No.: PCT/JP2007/066967

§ 371 (c)(1),
(2), (4) Date: Nov. 11, 2009

(87) PCT Pub. No.: WO2008/029718

PCT Pub. Date: Mar. 13, 2008

(65) Prior Publication Data

US 2010/0117255 A1 May 13, 2010

(30) Foreign Application Priority Data

Sep. 8, 2006 (JP) ..... 2006-243956

(51) Int. Cl.
*B05D 3/12* (2006.01)

(52) U.S. Cl.
USPC ..... 427/359; 427/209; 427/211; 118/224; 118/231; 118/244; 118/246; 118/255; 264/129; 264/134

(58) Field of Classification Search
None
See application file for complete search history.

(56) References Cited

U.S. PATENT DOCUMENTS

| | | | | | |
|---|---|---|---|---|---|
| 3,844,813 | A * | 10/1974 | Leonard et al. | ..... | 427/173 |
| 5,792,260 | A * | 8/1998 | Rantanen et al. | ..... | 118/217 |
| 5,820,935 | A * | 10/1998 | Kashiwabara et al. | ..... | 427/359 |
| 6,696,098 | B2 * | 2/2004 | Takekuma et al. | ..... | 427/172 |
| 6,886,464 | B2 * | 5/2005 | Inoue et al. | ..... | 101/485 |
| 2003/0113456 | A1 * | 6/2003 | Ichikawa et al. | ..... | 427/355 |
| 2009/0079105 | A1 * | 3/2009 | Nishimori et al. | ..... | 264/129 |

FOREIGN PATENT DOCUMENTS

| | | | |
|---|---|---|---|
| JP | 1169863 | | 1/1983 |
| JP | 2805177 | B * | 7/1993 |
| JP | 5177159 | A * | 7/1993 |

(Continued)

OTHER PUBLICATIONS

International Search Report dated Nov. 20, 2007, application No. PCT/JP2007/066967.

(Continued)

*Primary Examiner* — Timothy Meeks
*Assistant Examiner* — Michael P Rodriguez
(74) *Attorney, Agent, or Firm* — RatnerPrestia

(57) ABSTRACT

A first coating rod placed on an upper-surface side of a resin film is pressed onto the resin film in a state where the first coating rod is circumscribed and supported by support members each comprising a pair of rollers and spaced with intervals therebetween in a length direction of the first coating rod so that the first coating rod is rotated in a forward direction at a speed substantially equal to that of the resin film, and a lower surface of the resin film is supported by a guide roll or a second coating rod placed on a downstream side of the first coating rod and an upstream side of a tenter so that the coating liquid continuously measured and supplied to an upper surface of the resin film is smoothened by the first coating rod.

5 Claims, 8 Drawing Sheets

(56) References Cited

FOREIGN PATENT DOCUMENTS

| | | | | |
|---|---|---|---|---|
| JP | 2000/80186 | A | | 3/2000 |
| JP | 2000080186 | A | * | 3/2000 |
| JP | 2000/107661 | A | | 4/2000 |
| JP | 2000/153202 | A | | 6/2000 |
| JP | 2000153202 | A | * | 6/2000 |
| JP | 2001/276713 | A | | 10/2001 |
| JP | 2001276713 | A | * | 10/2001 |
| JP | 2003/080156 | A | | 3/2003 |
| JP | 2003080156 | A | * | 3/2003 |
| JP | 2003/181357 | A | | 7/2003 |
| JP | 2004-113963 | | | 4/2004 |
| JP | 2004-174410 | | | 6/2004 |
| JP | 2005-41205 | | | 2/2005 |
| WO | WO 2006095669 | A1 | * | 9/2006 |

OTHER PUBLICATIONS

"Coating Methods", by Yuji Harasaki, Japan, published by Maki Shoten, Oct. 30, 1979, p. 56 (w/English translation).

* cited by examiner (a) In the case where a position of the upper surface of the guide roll 2 was lower than that of the lower surface of the coating rod 11

(b) In the case where a position of the upper surface of the guide roll 2 was higher than that of the lower surface of the coating rod 11

COATING METHOD AND COATING APPARATUS

This is a U.S. National Phase application of application number PCT/JP2007/066967, filed Aug. 31, 2007 (which is incorporated herein by reference in its entirety), which claims priority benefit of JP 2006-243956 (filed Sep. 8, 2006).

FIELD OF THE INVENTION

The present invention relates to a coating method and a coating apparatus.

BACKGROUND OF THE INVENTION

A resin film, for example, a biaxially stretched polyester film, has been widely used as a base film of optical members such as touch panel, liquid crystal display and plasma display. An example of the optical members in which the resin film is used is a hard coat film attached to a front surface of the display. The hard coat film is used such that hard coat films having scratch-resistant, wear-resistant properties, and the like are multilayered on one surface of the resin film. The hard coat films having such properties are constituted by, for example, acrylic resin, urethane resin, melamine resin, epoxy resin, or polyester resin and have preferably a film thickness of 1 to 15 μm.

As a conventional method for obtaining the multilayered hard coat films, the surface of the resin film is coated with a coating liquid obtained by diluting monomer or oligomer of active-ray-curing resin with an organic solvent by means of the die coating method, rod coating method, roll coating method, gravure coating method or the like, the organic solvent is thereafter evaporated in a drying oven, and then, the surface of the resin film is irradiated by active ray such as ultraviolet ray and cured. A large volume of organic solvent is used in the conventional method, however, there are problems not only of imposing a heavy burden on environments but also of increasing manufacturing costs since the method requires a coating/drying apparatus provided with an explosion-proof equipment.

In order to deal with the disadvantage, as disclosed in Patent Document 1, the hard coat film exerting the scratch-resistant and wear-resistant properties and the like was invented, wherein a coating liquid containing acrylic oligomer and reactant diluent as its main components was applied during a resin film manufacturing process. Such coating liquid is advantageous in that the impact on the environments can be reduced because the amount of the organic solvent to be contained can be reduced to such an extent that safety can be guaranteed when the coating liquid is applied in a conventional resin film manufacturing apparatus not provided with the explosion-proof equipment. Further, since a coating step (referred to as off-line coating), which has been conventionally carried but in a coating-only line apart from a manufacturing line for the resin film, is unnecessary, the manufacturing costs of the hard coat film can be reduced. However, the conventional coating liquid diluted with the organic solvent has the viscosity in the range of approximately 1 to 10 mPa·s, while the viscosity of the coating liquid in which the amount of the organic solvent is minimized is at least 200 mPa·s. Thus, the proposed coating liquid has newly generated a problem of the significant deterioration of a coating performance.

In the generally called in-line coating wherein the coating liquid is applied during the resin film manufacturing process, an oven in an apparatus called a tenter is conventionally used so that the applied coating liquid is dried. The tenter is an apparatus which nips both ends of the resin film with a clip and laterally stretches or simultaneously biaxially stretches the resin film. The clip nips the resin film intermittently, which generates vibrations in the resin film. It is known that the vibrations are transmitted to a coating unit, which generates a coating unevenness called transverse thickness-difference lines (for example, see Patent Document 2).

Therefore, the rod coating method is widely used in the in-line coating. In a known example of the rod coating method, for example, as disclosed in Patent Document 3, a coating rod is pressed onto a lower surface of the resin film in a state where the coating rod is circumscribed and supported by support members each comprising a pair of rollers and spaced with intervals therebetween in a length direction of the coating rod, and the excess coating liquid supplied to the resin film in advance is scraped off (measured). Such rod-coating method makes it difficult for the transverse thickness-difference lines to occur because a peak of a groove formed on an outer peripheral surface of the coating rod contacts the resin film, which suppresses the vibrations of the resin film. The phrase "a peak of a groove contacts the resin film" denotes a state where the peak of the groove is basically in direct contact with the resin film. In a practical sense, however, a very thin film derived from the coating liquid may be interposed between the peak of the groove and the resin film, which is also included in the contact state described above.

The rod coating method is suitably used for the in-line coating because an apparatus has a simple configuration and is easily operable and maintainable and coating can be applied at a relatively high speed. However, the range of the viscosity of the coating liquid suitable for the rod coating method is usually at most 100 mPa·s (for example, Non-Patent Document 1).

One of the reasons why it is difficult to apply the coating liquid having a high viscosity in the rod coating method is that the coating liquid having a high viscosity has a low fluidity and it is thus difficult to collect and reuse the coating liquid scraped off by the coating rod. Even if the coating liquid could be collected by means such as suction, a special apparatus and an extra processing time would be required in order to remove air bubbles and foreign matters included in the coating liquid, which would deteriorate the productivity. As an example of the rod coating method in which the coating liquid is applied without being reused, there is a known method as disclosed in Patent Document 4, wherein the coating liquid is supplied from the support members of the coating rod so that an amount of the coating liquid picked up by the coating rod and an amount of the coating liquid applied to the resin film can be equal to each other. In this method, however, the viscosity of the coating liquid is preferably at most 100 mPa·s. If the coating liquid has a high viscosity, the coating liquid is streaked when it is picked up from the support members by the coating rod, and a liquid pool formed immediately before portions of the coating rod and the resin film contacting each other is unevenly generated in a width direction of the resin film. Thus, a coating defect called coating streaks is easily generated.

As an example of the rod coating method in which the coating liquid is applied without being reused such that the liquid pool formed immediately before the portions of the coating rod and the resin film contacting each other is evenly generated, there is a known method as disclosed in Patent Document 5, wherein the coating liquid is supplied to an upper surface of the resin film by a die arranged in the vicinity of the coating rod. According to this method, the liquid pool formed immediately before the portions of the coating rod and the resin film contacting each other is spread by the action of gravity, and thereby evenly spread in the width direction of the resin film even when the coating liquid have a high viscosity. However, when the coating liquid passes through a space surrounded by the coating rod and the resin film (that is, the groove formed on the outer peripheral surface of the coating rod), the space between the coating rod and the resin film is subjected to a high pressure in the case where the coating liquid has a high viscosity because a pressure generated in the coating liquid is proportional to the viscosity of the coating liquid. In the conventional in-line coating, the resin film coated with the coating liquid, both ends of which are hipped by the clip of the tenter, is easily deflected in the width direction thereof. If the viscosity of the coating liquid is high, therefore, the coating rod and the resin film are separated from each other at the center of the resin film by the pressure of the coating liquid, which causes such problems that a coating thickness may be larger than desired, and the coating thickness may be uneven in the width direction of the resin film.

There is a conventionally known method for preventing the deflection of the resin film in the width direction thereof (for example, see Patent Documents 6 and 7), wherein the upper surface of the resin film is pressed by guide rolls provided before and forth the coating rod when the lower surface of the resin film is coated with the coating liquid by the coating rod so that a constant winding angle of the resin film relative to the coating rod is obtained. Also in the method, however, the viscosity of the coating liquid is preferably at most 100 mPa·s due to the problems described above, such as the collection of the coating liquid and the generation of streaks when the coating liquid is picked up by the coating rod, because the lower surface of the resin film is coated with the coating liquid. Further, the coating liquid cannot be applied to both surfaces of the resin film at the same time.

Examples of the coating method suitable for applying the coating liquid having the viscosity of at least 200 mPa·s, which are known, are the die coating method, roll coating method, gravure coating method and the like. According to these methods, a coating tool (die, coating roll, gravure roll) and the resin film are kept from contacting each other, and the coating liquid retained in a gap between the coating tool and the resin film is applied. Therefore, if these methods are applied to the in-line coating, the vibrations of the resin film caused by the tenter described above induce the vibrations of the coating liquid retained in the gap between the coating tool and the resin film, which easily results in the generation of the transverse thickness-difference lines. Further, an apparatus used therein has a complicate structure in comparison to the rod coating method, and an operation and maintenance of the apparatus are also complicated.

PATENT DOCUMENT 1 Japanese Patent Applications Laid-Open No. 2005-041205

PATENT DOCUMENT 2 Japanese Patent Applications Laid-Open No. 2004-174410

PATENT DOCUMENT 3 Japanese Patent Applications Laid-Open No. 2001-276713

PATENT DOCUMENT 4 Japanese Patent No. 1169863

PATENT DOCUMENT 5 Japanese Patent No. 2805177

PATENT DOCUMENT 6 Japanese Patent Applications Laid-Open No. 2000-107661

PATENT DOCUMENT 7 Japanese Patent Applications Laid-Open No. 2004-113963

NON-PATENT DOCUMENT 1 Page 56, "Coating Methods" by Yuji Harasaki, Japan, published by Maki Shoten on Oct. 30, 1979.

SUMMARY OF THE INVENTION

The present invention relates to one of or more of the foregoing problems, so that hard coat films having scratch-resistant, wear-resistant properties, and the like can be multilayered on one surface of a resin film during a manufacturing process of the resin film, and, if necessary, functional films which are easily lubricatable and easily adherable can be further multilayered on the other surface opposite to the hard coat films. Provided area coating method and a coating apparatus, wherein an apparatus configuration is simple, the apparatus is easily operable and maintainable, and the rod coating method capable of avoiding the generation of transverse thickness-difference lines can be adopted for coating. Also provided are a coating method and a coating apparatus, wherein a coating liquid having a relatively high viscosity can be applied to one surface of the resin film and a coating liquid having a low viscosity can be applied to the opposite surface at the same time during the resin film manufacturing process, an apparatus configuration is simple, and the apparatus is easily operable and maintainable.

The present disclosure describes a coating method for applying a coating liquid to an upper surface of a running resin film with a first coating rod during a manufacturing process of the resin film and then drying and/or curing the coating liquid in a tenter, wherein the first coating rod placed on the upper-surface side of the resin film is pressed onto the resin film in a state where the first coating rod is circumscribed and supported by support members each comprising a pair of rollers and spaced with intervals therebetween in a length direction of the first coating rod so that the first coating rod is rotated in a forward direction at a speed substantially equal to that of the resin film, and a lower surface of the resin film is supported by a guide roll placed on a downstream side of the first coating rod and an upstream side of the tenter so that the coating liquid continuously measured and supplied to the upper surface of the resin film is smoothened by the first coating rod.

An embodiment of the present invention provides the coating method wherein a distance between axial centers of the first coating rod and the guide roll is at least Dc+Dg and at most W/2 in which a width of the resin film is W, a diameter of the first coating rod is Dc, and a diameter of the guide roll is Dg.

An embodiment of the present invention provides the coating method wherein a coating liquid having a viscosity in the range of 200 to 2,000 mPa·s is used as the coating liquid supplied to the upper surface of the resin film.

An embodiment of the present invention provides a manufacturing method of a resin film with a coating film, wherein polymer is extruded by an extruder, the obtained polymer is formed into a sheet shape and used as the resin film, and the coating liquid is applied to the resin film with the coating method so that the coating film is formed.

An embodiment of the present invention provides the coating method wherein the coating liquid is applied to a lower surface of the resin film and a second coating rod is used as the guide roll so that the coating liquid excessively supplied to the lower surface of the resin film is measured by the second coating rod.

Further, another embodiment of the present invention provides another coating method for applying a coating liquid to both surfaces of a running resin film with a first coating rod and a second coating rod during a manufacturing process of the resin film and then drying and/or curing the coating liquid in a tenter, wherein the first coating rod placed on an upper-surface side of the resin film is pressed onto the resin film in a state where the first coating rod is circumscribed and supported by support members each comprising a pair of rollers and spaced with intervals therebetween in a length direction of the first coating rod so that the first coating rod is rotated in a forward direction at a speed substantially equal to that of the resin film, the second coating rod placed on a downstream side of the first coating rod, an upstream side of the tenter and a lower-surface side of the resin film is pressed onto the resin film in a state where the second coating rod is circumscribed and supported by support members each comprising a pair of rollers and spaced with intervals therebetween in a length direction of the second coating rod so that the second coating rod is rotated in the forward direction at the speed substantially equal to that of the resin film, and a first coating liquid continuously measured and supplied to an upper surface of the resin film is smoothened by the first coating rod and a second coating liquid excessively supplied to a lower surface of the resin film is measured by the second coating rod.

An embodiment of the present invention provides the coating method wherein a distance between axial centers of the first coating rod and the second coating rod is at least Dc+D2 and at most W/2 in which a width of the resin film is W, a diameter of the first coating rod is Dc, and a diameter of the second coating rod is D2.

An embodiment of the present invention provides the coating method wherein a coating liquid having a viscosity in the range of 200 to 2,000 mPa·s is used as the first coating liquid supplied to the upper surface of the resin film and a coating liquid having a viscosity in the range of 1 to 50 mPa·s is used as the second coating liquid supplied to the lower surface of the resin film.

An embodiment of the present invention provides a manufacturing method of a resin film with a coating film, wherein polymer is extruded by an extruder and the obtained polymer is formed into a sheet shape and used as the resin film, and the coating liquid is applied to the resin film with the coating method so that the coating film is formed.

Further, another embodiment of the present invention provides a coating apparatus, provided during a resin film manufacturing process, for applying a coating liquid to an upper surface of a running resin film with a first coating rod, comprising: the first coating rod placed on an upper-surface side of the resin film; a support unit provided with a plurality of support members each comprising a pair of rollers which rotatably circumcise and support the first coating rod, the support members being spaced with intervals therebetween in a length direction of the first coating rod; a pressing unit which presses the first coating rod supported by the support unit onto the resin film; a guide roll placed on a downstream side of the first coating rod and a lower-surface side of the resin film; and a coating liquid supply unit which continuously supplies the coating liquid to the upper surface of the resin film.

An embodiment of the present invention provides the coating apparatus wherein a distance between axial centers of the first coating rod and the guide roll is at least Dc+Dg and at most W/2 in which a width of the resin film is W, a diameter of the first coating rod is Dc, and a diameter of the guide roll is Dg.

An embodiment of the present invention provides the coating apparatus for applying the coating liquid also to a lower surface of the resin film, wherein the guide roll is used as a second coating rod and a coating liquid supply unit which continuously supplies the coating liquid to the lower surface of the resin film is provided.

Further, another embodiment of the present invention provides a coating apparatus, provided during a resin film manufacturing process, for applying a coating liquid to both surfaces of a running resin film with a first coating rod and a second coating rod, comprising: the first coating rod placed on an upper-surface side of the resin film; a support unit provided with a plurality of support members each comprising a pair of rollers which rotatably circumcise and support the first coating rod, the support members being spaced with intervals therebetween in a length direction of the first coating rod; a pressing unit which presses the first coating rod supported by the support unit onto the resin film; the second coating rod placed on a downstream side of the first coating rod and a lower-surface side of the resin film; a second support unit provided with a plurality of support members each comprising a pair of rollers which rotatably circumcise and support the second coating rod, the support members being spaced with intervals therebetween in a length direction of the second coating rod; a first coating liquid supply unit which continuously supplies a first coating liquid to the upper surface of the resin film; and a second coating liquid supply unit which continuously supplies a second coating liquid to a lower surface of the resin film.

An embodiment of the present invention provides the coating apparatus wherein a distance between axial centers of the first coating rod and the second coating rod is at least Dc+D2 and at most W/2 in which a width of the resin film is W, a diameter of the first coating rod is Dc, and a diameter of the second coating rod is D2.

As the resin film in an embodiment of the present invention, a resin film which can be formed by means of melting film formation or solution film formation can be suitably used. Specific examples thereof are films made of polyester, polyolefin, polyamide, polyphenylenesulfide, acetate, polycarbonate, acrylic resin and the like. Among them, any film made of thermoplastic resin superior in its transparency, mechanical strength, stability in dimension, and the like, is preferably used. In order to use the film as a base film of an optical member in an image display apparatus, the film preferably has a high light transmittance and a low haze value. Therefore, a film made of at least one selected from polyester, acetate and acrylic resin is preferably used, and the polyester film is particularly preferable in view of transparency, haze value and mechanical characteristics.

The resin film may be a film comprising a single layer or a composite film having a multilayer structure comprising at least two layers. In the composite film, either of the same resin or chemically different two resins may constitute an inner layer and a surface layer.

The phrase "rotate at a speed substantially equal to that of the resin film" means that the first coating rod is rotated so that a speed difference between a circumferential speed of the first coating rod and a running speed of the film is at most ±10%. The speed difference is preferably smaller, and the first coating rod is preferably rotated so that the speed difference is at most ±5%. The first coating rod is more preferably rotated so that the speed difference is at most ±1%. The first coating rod may be aggressively driven so as to synchronize with the film running speed, or, in order to simplify the apparatus configuration and easily operate the apparatus, the first coating rod may be rotated while being slaved with the film so as to rotate at substantially the equal speed. The description relating to the rotation is also applied to the second coating rod.

The phrase "smoothen by the first coating rod" means that the coating liquid previously measured and supplied is smoothened by the first coating rod, and "measure by the second coating rod" means that an excess portion of the coating liquid excessively supplied is scraped off by the second coating rod.

The phrase "excessively supplied to the lower surface of the resin film" means an excess supply of the coating liquid in comparison to an amount of the second coating liquid applied onto the resin film after the measurement by the second coating rod.

The viscosity of the coating liquid is measured by Rheometer (manufactured by Rheo Technology LTD., RC20) according to standards of JIS Z8803. In the measurement, measurement conditions, a temperature and a shear rate of the coating liquid, ideally employ an actual temperature and an actual shear rate of the coating unit. However, it is difficult to accurately know the temperature and the shear rate of the coating liquid in the coating unit. In order to know the temperature of the coating liquid, a temperature at the center of a coating liquid pool is measured by a radiation thermometer, and a value close to the temperature of the coating unit may be preferably used. The shear rate is very small because the coating rod is rotated in the forward direction at the speed substantially equal to that of the resin film in the present invention. Therefore, the shear rate in the range of 1 to 50/s may be preferably used, and the shear rate of 10/s is reasonably used as a typical value.

EFFECT OF THE INVENTION

According to a coating method and a coating apparatus of an embodiment of the present invention, a coating liquid having a high viscosity in comparison to that of the conventional technology can be applied to an upper surface of a running resin film by means of the rod coating method wherein an apparatus configuration is simple and the apparatus is easily operable and maintainable. The high-viscosity coating liquid can be applied without the generation of transverse thickness-difference lines in the in-line coating. Therefore, the coating liquid which was conventionally diluted with an organic solvent to reduce its viscosity can be replaced with a coating liquid which is not diluted with the organic solvent, which decreases a burden imposed on environments.

Further, a part of the coating process, which was conventionally carried out in the off-line coating where an explosion-proof apparatus was provided because the organic solvent was used, can be carried out in the in-line coating. Thus, manufacturing costs can be reduced. Further, according to another coating method and coating apparatus of an embodiment of the present invention, a coating liquid having a low viscosity substantially equal to that of the conventional technology can be applied to a lower surface at the same time while the application of a coating liquid having a higher viscosity than to that of the conventional technology to the upper surface of the running resin film.

DESCRIPTION OF REFERENCE SYMBOLS

Figure 1:
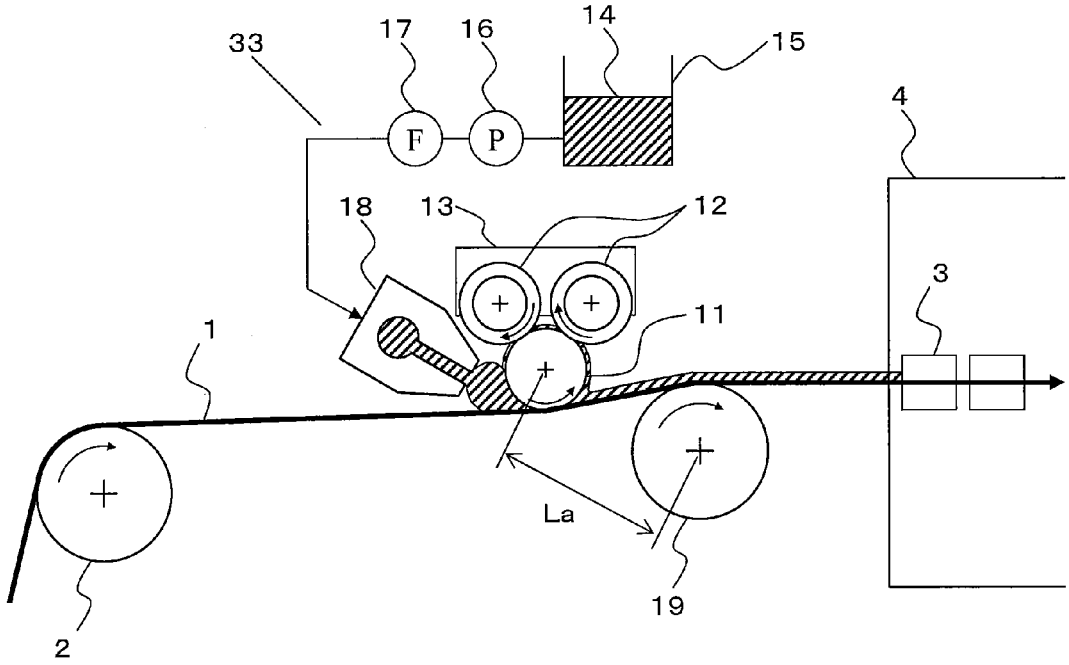
FIG. 1 is a side view of a coating apparatus according to a first embodiment of the present invention.

| | |
|---|---|
| 1 | resin film |
| 2, 19 | guide roll |
| 3 | clip |
| 4 | tenter |
| 11, 21 | coating rod |
| 12, 22 | roller |
| 13, 23 | support member |
| 14, 24 | coating liquid |
| 15, 25 | tank |
| 16, 26 | pump |
| 17, 27 | filter |
| 18, 28 | discharge head |
| 29 | liquid receiver |
| 31, 41 | support unit |
| 32, 42 | holder |
| 33, 43 | coating liquid supply unit |
| 63 | groove having V-letter shape as support member |
| L1, L2 | interval between support members |
| La | distance between axial centers of coating rod 11 and guide roll 19 |
| Lb | distance between axial centers of coating rod 11 and coating rod 21 |
| θ | winding angle |
| θ1 | tilt of tangent line corresponding to film path between coating rod 11 and guide roll 2 from its level |
| θ2 | tilt of tangent line corresponding to film path between coating rod 11 and guide roll 2 or coating rod 21 from its level |
| W | width of resin film 1 |
| Dc | diameter of coating rod 11 |
| Dg | diameter of guide roll 19 |
| D2 | diameter of coating rod 21 |

DETAILED DESCRIPTION

A process for manufacturing a resin film according to an embodiment of the present invention is preferably a manufacturing process wherein a film formed into a sheet shape by means of melting film formation or solution film formation and then biaxially stretched. The biaxial stretching method is preferably a sequential biaxial stretching method or a simultaneous biaxial stretching method, and a tenter is used in a lateral stretching step in the sequential biaxial stretching method and a longitudinal and lateral stretching step in the simultaneous biaxial stretching method. A coating method according to an embodiment of the present invention is preferably carried out between a longitudinal stretching step and the lateral stretching step in the sequential biaxial stretching method, and between a casting step and the longitudinal and lateral stretching step in the simultaneous biaxial stretching method, and a coating apparatus according to an embodiment of the present invention is preferably provided immediately before the tenter which dries and/or cures an applied coating liquid in an oven provided therein.

Figure 7:
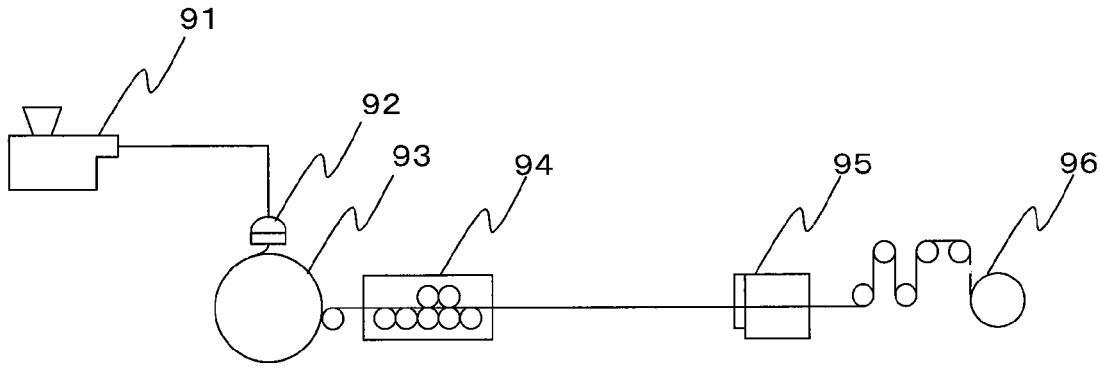
FIG. 7 is a schematic view a resin film manufacturing process by a sequential biaxial stretching method according to an aspect of the present invention.
Figure 8:
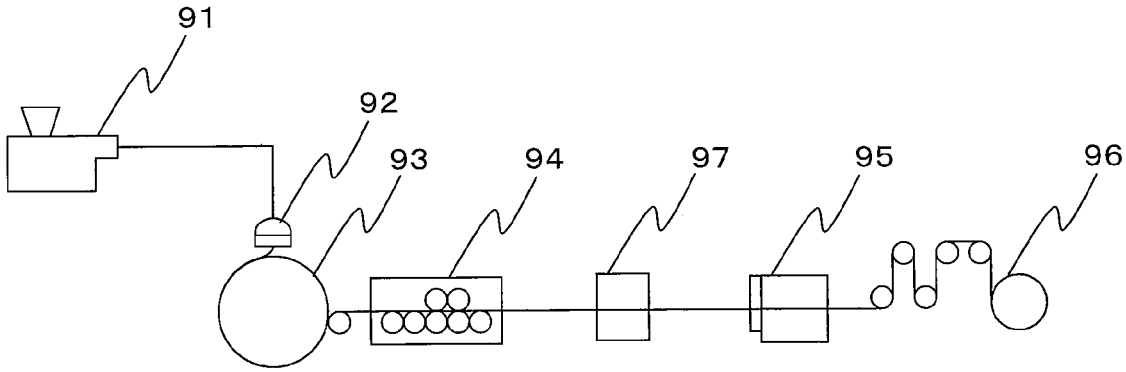
FIG. 8 is a schematic view of an apparatus configuration when a coating liquid is applied to the resin film in the process shown in FIG. 7.

An apparatus configuration upon applying the coating liquid during the resin film manufacturing process is described referring to FIGS. 7 and 8. FIG. 7 illustrates a mode of the resin film manufacturing process according to the sequential biaxial stretching method. FIG. 8 illustrates an apparatus configuration upon applying the coating liquid to the resin film during the process shown in FIG. 7. In the resin film manufacturing process wherein the sequential biaxial stretching method is adopted, as shown in FIG. 7, an extruder 91, a mouth ring 92, a cast drum 93, a longitudinal stretcher 94, a lateral stretcher 95 and a winding roll 96 are used. An unstretched film obtained by melting and extruding polymer by the extruder 91, discharging it from the mouth ring 92 into a sheet shape, and then cooling down and solidifying it by the cast drum 93 is stretched in a length direction by the longitudinal stretcher 94 so that an uniaxially stretched film is obtained, and the obtained uniaxially stretched film is stretched in a width direction by the lateral stretcher 95 so that a biaxially stretched film is obtained, and the biaxially stretched film is continuously taken up by the winding roll 96. When the coating liquid is applied to the resin film during the process, as shown in FIG. 8, a coating apparatus 97 is provided between the longitudinal stretcher 94 and the lateral stretcher 95 so that the uniaxially stretched resin film is coated with the coating liquid. One example that the sequential biaxial stretching method is adopted is illustrated, however, the present coating apparatus may be provided before a simultaneous biaxial stretcher in the case the simultaneous biaxial stretching method is adopted.

When a running speed of the resin film in the present invention is too high, coating streaks are easily generated. When the running speed is too low, it is easily variable. Therefore, the running speed is preferably 5 to 100 m/min, and more preferably 10 to 60 m/min at a position/where the coating liquid is applied.

A thickness of the resin film used in the present invention is not particularly limited, but, when the resin film is used as a base film of an optical member, the thickness after the biaxial stretching is preferably 10 to 500 μm, and more preferably 20 to 300 μm in view of mechanical strength, handling property and the like.

A tensile force per unit width applied in a running direction of the resin film in the present invention is preferably at least 3,000 N/m and at most 10,000 N/m. A manufacturing apparatus for obtaining a sequentially biaxially stretched polyethylene terephthalate film is generally designed so that the tensile force applied between the longitudinal stretcher and the lateral stretcher is at most 10,000 N/m. Therefore, the tensile force should stay within the upper-limit value set in the designing process. The tensile force being smaller than 3,000 N/m may result in an unstable running state of the resin film.

Figure 3:
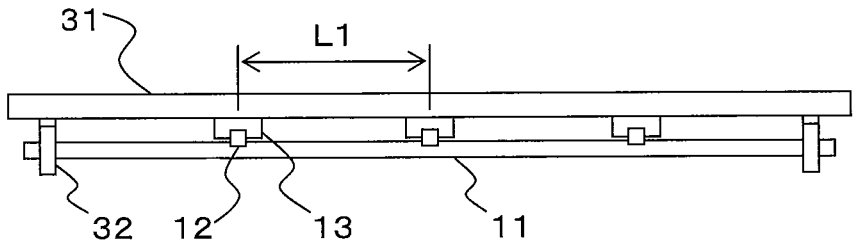
FIG. 3 is a front view illustrating a coating rod placed on an upper-surface side of a resin film and a support unit according to the first embodiment.

The present invention is further described below referring the drawings. First, a first embodiment of the present invention is described. FIG. 1 is a side view of a coating apparatus according to the first embodiment of the present invention. FIG. 3 is a front view illustrating a coating rod and a support unit provided on an upper-surface side of the resin film according to the first embodiment of the present invention.

As a coating rod 11 being a first coating rod, a wire rod that a wire is wound around an outer peripheral surface of a smooth round bar so that a groove is formed, or a rolled rod that a groove is formed on an outer peripheral surface of a smooth round bar by means of a rolling process, for example, can be used. A material used for the coating rod 11 is preferably stainless, and SUS304 or SUS316 are particularly preferably used. A surface of the coating rod 11 may be subjected to a surface processing such as hard chrome plating. A diameter of the coating rod 11 is preferably 5 to 40 mm, and more preferably 10 to 30 mm. The coating rod 11 is rotated at a speed substantially equal to that of a resin film 1 in a forward direction so that any scratches are not generated in the resin film 1.

A coating amount of the coating liquid 14 is preferably 2 to 100 g/m$^2$, and more preferably 4 to 50 g/m$^2$ when it is still wet immediately after the application. The coating amount can be adjusted depending on a size of the groove formed in the coating rod 11 as an the conventional rod coating method. The size of the groove is changeable by changing a diameter of the wire to be wound when the wire rod is used as the coating rod 11, and by the rolling process with dies having different groove depths and/or groove pitches when the rolled rod is used as the coating rod 11.

A coating liquid supply unit 33 which continuously measures and supplies a coating liquid 14 to an upper surface of the resin film 1 comprises a tank 15, a pump 16, a filter 17 and a discharge head 18. Other than these elements, an apparatus for adjusting a temperature of the coating liquid 14, a defoaming apparatus, and the like, may be further provided. The coating liquid 14 measured and supplied to the upper surface of the resin film 1 by the pump 16 forms a liquid pool on an upstream side of portions of the coating rod 11 and the resin film 1 contacting with each other, and smoothened by the coating rod 11. A coating width of the coating liquid 14 is adjusted depending on a discharge amount from the pump 16. As the pump 16, because a quantitative performance and a low pulsation property are demanded, a diaphragm pump and a mohno pump are preferable.

As shown in FIG. 3, a plurality of support members 13 of the coating rod 11 each comprise a plurality of pairs of rollers 12 and are spaced with intervals therebetween in a length direction of the coating rod 11. When the coating liquid 14 having a high viscosity is smoothened by the coating rod 11, a pressure of the coating liquid acting between the coating rod 11 and the resin film 1 is increased. Therefore, it is necessary to strongly push the coating rod 11 against the resin film 1 so that the coating rod 11 and the resin film 1 are not separated from each other. A conventionally support member having a configuration that the coating rod is inserted into a V-letter groove extending in an axial direction of the coating rod Is provided or a semicircular groove is known, but the support member is not preferably used because a fractional resistance between the coating rod 11 and the support member is increased as a force by which the coating rod 11 is pressed onto the resin film 1 is increased, which results in the poor rotation of the coating rod. In the present embodiment, wherein the coating rod 11 is supported by the support members 13 each comprising the pair of rollers 12 so as to circumferentially freely rotate, the frictional resistance between the coating rod 11 and the support members 13 can be reduced, thus, the poor rotation of the coating rod 11 can be prevented from occurring even if the pressing force is large.

A diameter of the roller 12 is preferably at least 8 mm because a universal bearing can be used, and is preferably at most twice as large as the diameter of the coating rod 11 in order to guarantee a space necessary for locating the rollers 12. A width of the roller 12 is preferably at least 3 mm because a universal bearing can be used, and is preferably at most twice as large as the diameter of the coating rod 11 because a partial contact between the coating rod 11 and the rollers 12 can be reduced. In order to lessen the wear of the coating rod 11, a material haying a degree of hardness lower than that of the coating rod 11 is preferably used for a surface layer of the roller 12, and preferable examples of the material are synthetic rubber and elastomer. The elastomer is rubber-like elastic resin which can be melted and formed by the injection molding, extrusion molding, cast molding, blow molding, inflation molding or the like. Preferable examples of the elastomer are urethane elastomer, polyester elastomer and polyamide elastomer, and thermoplastic polyurethane elastomer superior in its wear resistance and mechanical strength is particularly preferably used. A thickness of the elastomer formed on the surface layer of the roller 12 is preferably 0.5 to 6 mm. A degree of hardness of the elastomer is preferably 60 to 98 A (measured according to standards of JIS K6253).

As shown in FIG. 3, a support unit 31 of the coating rod 11 comprises the support members 13 each provided with a pair of rollers 12 and a holder 32 which allows the coating rod 11 to circumferentially freely rotate at least at an end thereof and constrains the movement of the coating rod 11 in axial, upward and downward directions. An inter-member distance L1 of the support members 13 is preferably set so that a deflection amount of the coating rod 11 when it smoothens the coating liquid 14 having a high viscosity is at most 10 μm. The deflection amount is obtained from a formula expressing the strength of materials based on the geometrical moment of inertia of the coating rod 11 and Young's modulus, wherein a reaction force of the resin film 1 in an out-of-plane direction calculated from the tensile force applied in the running direction of the resin film 1 and a winding angle of the resin film 1 relative to the coating rod 11 is regarded as a uniformly distributed load applied to the coating rod 11, and the rollers 12 serves as support points. If the load applied to the coating rod 11 cannot be calculated, the inter-member distance L1 of the support members 13 is preferably set to be 7 to 15 times as large as the diameter of the coating rod 11 only as a rough standard. A pressing unit for the coating rod 11 (not shown) is constituted to move the support unit 31 upward and downward and fix it at a discretionary position. More specifically, the support unit 31 may be placed to be movable only upward and downward with a linear guide or the like, and pressed and fixed to a stopper with an air cylinder, an oil cylinder or the like. Further, the support unit 31 may be transferred to any position and fixed thereto with ball screws or the like.

A guide roll 19 which supports an entire width of the resin film 1 from a lower-surface side thereof is provided on a downstream side of the coating rod 11 and an upstream side of the tenter 4. As described above, the pressure of the coating liquid acting between the coating rod 11 and the resin film 1 is increased when the coating liquid 14 having a high viscosity is smoothened by the coating rod 11. In the conventional process wherein the guide/roll 19 is not provided, only both ends of the resin film 1 on the downstream side of the coating rod 11 are held by the tenter 4. Therefore, the tensile force applied in the running direction of the resin film 1 is smaller at the center of the resin film 1 than those at the ends thereof. Thus, the center portion of the resin film 1 is separated from the coating rod 11 if a large pressure is applied between the coating rod 11 and the resin film 1. In the present embodiment, since the guide roll 19 is provided on the downstream side of the coating rod 11 and the upstream side of the tenter 4, the deflection of the resin film 1 is controlled and the coating liquid 14 having a high viscosity can be applied. A general metal roll is suitably used as the guide roll 19, and a diameter thereof is preferably 100 to 200 mm.

As a more preferable mode of the present embodiment, a distance La between axial centers of the first coating rod 11 and the guide roll 19 is at least Dc+Dg and at most W/2 in which the width of the resin film 1 is W, the diameter of the first coating rod 11 is Dc, and the diameter of the guide roll 19 is Dg. If the distance La between the axial centers is smaller than Dc+Dg, the coating rod 11 and the guide roll 19 may interfere with each other. If the distance La between the axial centers is larger than W/2, the effect of reducing the deflection of the resin film 1 in the width direction thereof by the guide roll 19 is lessened.

As a more preferable mode of the present embodiment, the viscosity of the coating liquid 14 supplied to the upper surface of the resin film 1 is in the range of 200 to 2,000 mPa·s. If the viscosity of the coating liquid 14 is smaller than 200 mPa·s, the liquid pool formed on the upstream side of the portions of the coating rod 11 and the resin film 1 contacting with each other is more variable. Accordingly, a coating thickness may not be uniform, or the coating width may be variable, which may pollute a clip. In the rod coating method, coating streaks called rib streaks may be generated. The rib streaks are usually generated across the coating surface at such small pitches as at most 2 mm. The rib streaks are generally more easily generated as the viscosity of the coating liquid is higher. If the rib streaks are visually confirmed immediately after the coating liquid is applied, the coating liquid may be leveled off before dried or cured so that the generated rib streaks are reduced to such an extent that will not result in a questionable quality. The coating liquid can be easily leveled off so that the generated rib streaks are reduced to such an extent that will not result in a questionable quality as far as the viscosity of the coating liquid 14 is equal to 2,000 mPa·s or below. When the coating rod is rotated in the forward direction together with the resin film in the rod coating method, air bubbles may invade into meniscus generated in portions of the coating rod and the resin film separating from each other, and coating streaks called bubble streaks may be generated. The invasion of the air bubbles occurs because the pressure of the coating liquid is lower than the atmospheric pressure at a branch point of the flow of the coating liquid present in the meniscus. It is known that a pressure at the branch point is lower as the viscosity of the coating liquid is higher. The bubble streaks are more frequently generated if the viscosity of the coating liquid 14 is larger than 2,000 mPa·s.

Figure 5:
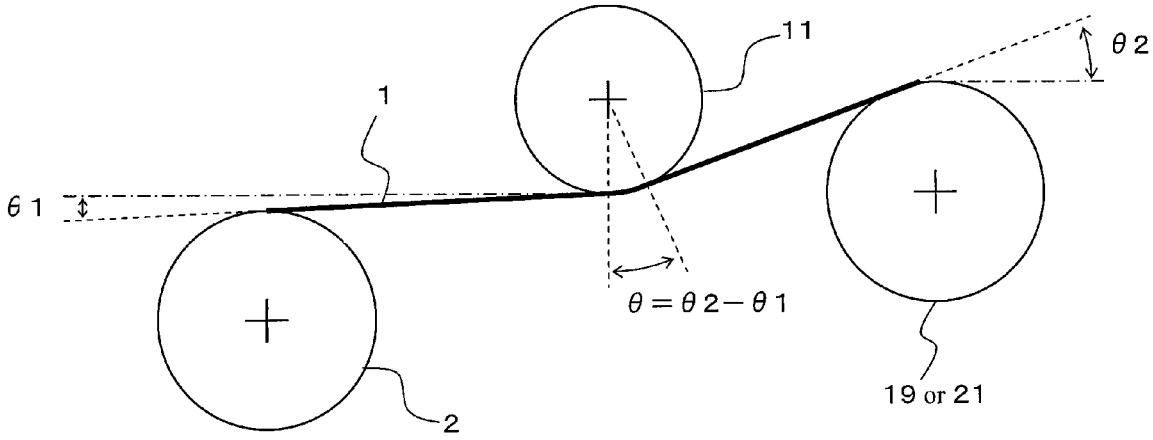
FIG. 5 is a conceptual view of a way of obtaining a winding angle.
Figure 5:
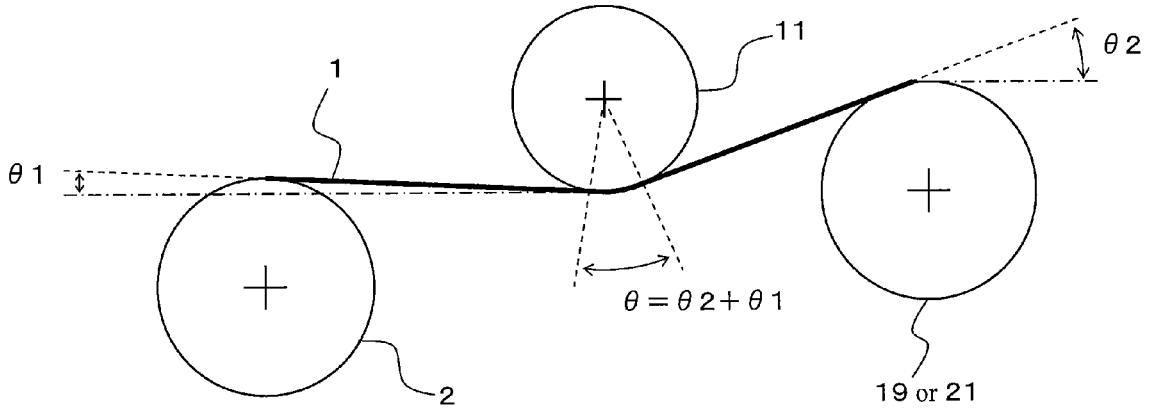

It is preferably to adjust a winding angle θ relative to the coating rod 11 while observing a state of the coating surface. If the winding angle θ is too small, the coating liquid 14 cannot be fully smoothened, and the coating thickness thereby cannot be uniform. If the winding angle θ is too large, the bubble streaks are unfavorably generated. The winding angle θ at which the coating surface shows the most favorable state is in the range of at least three degrees and at most 10 degrees. The winding angle θ, as shown in FIG. 5, a portion of the resin film 1 wound around the outer periphery of the coating rod 11 is represented by an angle of the coating rod 11 at its axial center on a cross sectional surface of the coating rod 11 perpendicular to its axis. Therefore, the winding angle θ can be obtained as a sum of or a difference between a tilt θ1 of a tangent line corresponding to a film path between the coating rod 11 and the guide roll 2 from its level and a tilt θ2 of a tangent line corresponding to a film path between the coating rod 11 and the guide roll 19 from its level.

Figure 2:
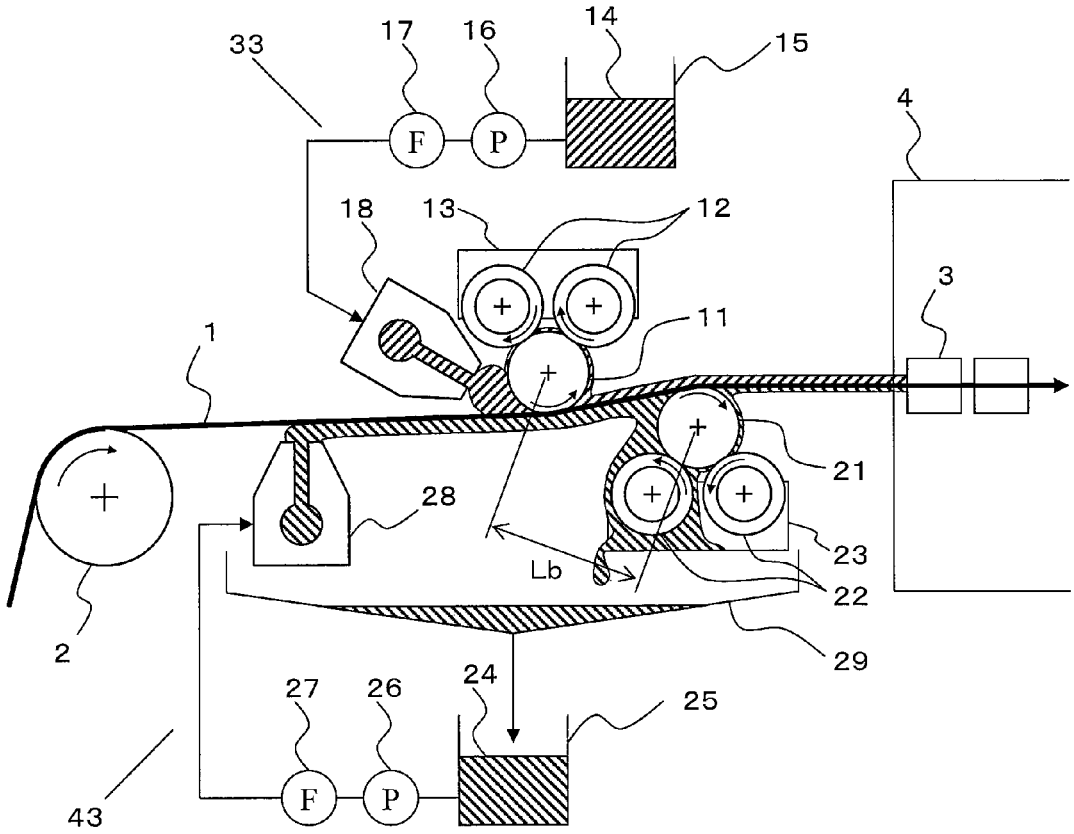
FIG. 2 is a side view of a coating apparatus according to a second embodiment of the present invention.
Figure 4:
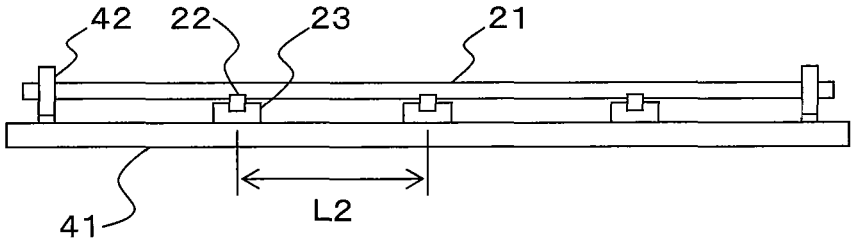
FIG. 4 is a front view illustrating a coating rod placed on a lower-surface side of a resin film and a support unit according to the second embodiment.

Next, a second embodiment 2 of the present invention is described. FIG. 2 is a side view of a coating apparatus according to the second embodiment of the present invention. FIG. 4 is a front view illustrating a coating rod and a support unit provided on a lower-surface side of a resin film according to the second embodiment of the present invention. The second embodiment is different from the first embodiment described earlier in that a coating rod 21, being a second coating rod, is used in place of the guide roll 19 in the first embodiment, so that the coating liquid 14, being a first coating liquid having a high viscosity, is applied to an upper surface of the resin film 1, and a coating liquid 24, being a second coating liquid having a low viscosity, is applied to a lower surface of the resin film 1. The coating rod 21 plays the role of the guide roll 19 described in the first embodiment, while further serving to form a coating film on the lower surface at the same time. The coating rod 11 being the first coating rod, a support unit 31 (comprising rollers 12, support members 13 and a holder 32), and a coating liquid supply unit 33 being a first coating liquid supply unit (comprising a tank 15, a pump 16, a filter 17 and a discharge head 18) are constituted as in the first embodiment, and will not be described in this section.

The coating rod 21 is provided on a downstream side of the coating rod 11, an upstream side of the tenter 4, and a lower-surface side of the resin film 1. As the coating rod 21, for example, a wire rod where a wire is wound around an outer peripheral surface of a smooth round bar so that a groove is formed, or a rolled rod where a groove is formed on an outer peripheral surface of a smooth round bar by a rolling process, which are conventionally known, can be used. A material used for the coating rod 21 is preferably stainless, and SUS304 or SUS316 are particularly preferably used. A surface of the coating rod 21 may be subjected to a surface processing such as hard chrome plating. A diameter of the coating rod 21 is preferably 5 to 40 mm, and more preferably 10 to 30 mm. The coating rod 21 is rotated at a speed substantially equal to that of a resin film 1 in a forward direction so that any scratches are not generated in the resin film 1.

A coating amount of the coating liquid 24 is preferably 2 to 100 g/m$^2$, and more preferably 4 to 50 g/m$^2$ when it is still wet immediately after the application. The coating amount can be adjusted depending on a size of the groove formed in the coating rod 21 as in the conventional rod coating method. The size of the groove is changeable by changing a diameter of the wire to be wound when the wire rod is used as the coating rod 21, and by the rolling process with dies having different groove depths and/or groove pitches when the rolled rod is used as the coating rod 21.

A coating liquid supply unit 43 which continuously measures and supplies the coating liquid 24 to the lower surface of the resin film 1 comprises a tank 25, a pump 26, a filter 27 and a discharge head 28. Other than these elements, an apparatus for adjusting a temperature of the coating liquid 24, a defoaming apparatus and the like may be further provided. An excess amount of the coating liquid 24, which has been excessively supplied to the lower surface of the resin film 1 by the pump 26, is scraped off by the coating rod 21 at the portions of the coating rod 21 and the resin film 1 contacting with each other. A coating width of the coating liquid 24 is adjusted depending on a discharge width of the discharge head 28. As the pump 26, because a quantitative performance and a low pulsation property are demanded, a diaphragm pump and a mohno pump are preferable.

As shown in FIG. 4, a plurality of support members 23 of the coating rod 21 each comprise a pair of rollers 22 and are spaced with intervals therebetween in a length direction of the coating rod 21. When the coating rod 11 is strongly pushed against the resin film 1, the coating rod 21 which supports the resin film 1 is also strongly pushed against the resin film 1. Accordingly, the coating rod 21 supports the resin film 1 so as to circumferentially freely rotate with the support members 23 comprising a pair of rollers 22 as in the coating rod 11.

A diameter of the roller 22 is preferably at least 8 mm because a universal bearing can be used, and is preferably at most twice as large as the diameter of the coating rod 11 in order to guarantee a space necessary for locating the rollers 22. A width of the roller 22 is preferably at least 3 mm because a universal bearing can be used, and is preferably at most twice as large as the diameter of the coating rod 21 because a partial contact between the coating rod 21 and the roller 22 can be reduced. A material preferably used for a surface layer of the roller 22 as well as a thickness and a degree of hardness thereof are similar to those adopted for the roller 12.

A support unit 41 of the coating rod 21, being a second support unit, comprises a plurality of support members 23 each provided with a pair of rollers 22 and a holder 42 which allows the coating rod 21 to circumferentially rotate at least at an end thereof and constrains the movement of the coating rod 21 in axial, upward and downward directions. An inter-member distance L2 of the support members 23 is preferably set so that a deflection amount of the coating rod 21 is at most 10 μm. The deflection amount is from a formula expressing the strength of materials based on the geometrical moment of inertia of the coating rod 21 and Young's modulus, wherein a reaction force of the resin film 1 in an out-of-plane direction calculated from the tensile force applied in the running direction of the resin film 1 and a winding angle of the resin film 1 relative to the coating rod 21 is regarded a uniformly distributed load applied to the coating rod 21, and the rollers 12 serve as support points. If the load applied to the coating rod 21 cannot be calculated, the inter-member distance L2 of the support members 23 is preferably set to be 7 to 15 times as large as the diameter of the coating rod 21 only as a rough standard.

As a more preferable mode of the present embodiment, a distance Lb between axial centers of the first coating rod 11 and the coating rod 21 is at least Dc+D2 and at most W/2 in which the width of the resin film 1 is W, the diameter of the first coating rod 11 is Dc, and the diameter of the coating rod 21 is D2 based on a same reason as that of the first embodiment.

The viscosity of the coating liquid 24 supplied to the lower surface of the resin film 1 is preferably low as in the conventional coating rod, and is particularly preferably 1 to 50 mPa·s. Preferably, a film formed by the coating liquid 24 is easily lubricatable so that the resin film can be easily transported or the film can be easily taken up, and is easily adherable so that the resin film 1 can be more closely adhered to other members. A preferable example of the coating liquid which exerts such characteristics is a water-based coating liquid including at least one selected from water-dispersed acrylic resin, polyurethane resin, and polyester resin as its main component.

A winding angle θ is similar to that of the first embodiment, however, θ2 denotes a tilt of a tangent line corresponding to a film path between the coating rod 11 and the coating rod 21 from its level.

EXAMPLES

Hereinafter, embodiments of the present invention are described with reference to Examples, but the present invention is not necessarily limited to the following Examples.

Example 1

A chip of polyethylene terephthalate (hereinafter, abbreviated as PET) having a limiting viscosity (sometimes also referred to as intrinsic viscosity) of 0.62 dl/g (measured in o-chlorophenol at 25° C. according to standards of JIS K7367) was sufficiently vacuum-dried at 180° C., thereafter supplied to the extruder 91 and melted there at 285° C., then extruded into a sheet shape from the T-letter mouth ring 92, and taken up by the mirror-surface cast drum 93 having the surface temperature of 23° C. and cooled down to be solidified by means of the electrostatic application cast method so that an unstretched film was obtained. Then, the unstretched film was heated by a group of rolls heated to 80° C. in the longitudinal stretcher, stretched by 3.2 times as long in the length direction while heating by an infrared heater, and then, cooled down by a cooling roll adjusted to 50° C., so that a uniaxially stretched resin film 1 was obtained. The width W of the resin film 1 was 1,600 mm. Next, the coating liquid 14 was applied to the upper surface of the obtained resin film 1 running at the speed of 25 m/min. by the coating apparatus shown in FIG. 1. Then, in the lateral stretcher 95, both ends of the resin film 1 coated with the coating liquid 14 were nipped with the clip 3 of the tenter 4, the resulting resin film was introduced into an oven at 90° C. and heated there and stretched by 3.7 times as long in the width direction in the oven at 100° C., and then, the coating liquid 14 was cured and the film was thermally fixed while being slackened by 5% in the width direction in the oven at 220° C. As a result, a biaxially stretched film, in which a cured resin of the coating liquid 14 was formed on one surface, was obtained. A tensile force between the longitudinal stretcher 94 and the lateral stretcher 95 was controlled by a dancer roll so that the tensile force per unit width applied in the rung direction of the film was 8,000 N/m.

As the coating rod 11 was used a rolled rod material SUS316; diameter Dc=16 mm; width=190 mm; groove pitch=250 μm, groove depth=54 μm (manufactured by OSG Corporation). The roller 12 was obtained when thermoplastic polyurethane elastomer having the thickness of 2.5 mm and the degree of hardness of 90 A was bonded to a surface of an aluminum pipe member having the diameter of 17 mm and the width of 16 mm. The support member 13 was adapted such that two rollers 12 were horizontally disposed with a distance between axial centers thereof=24 mm, and were circumferentially rotatable and constrained in their axial, upward and downward movements. In the support unit 31 shown in FIG. 3, ten support members 13 were spaced in the length direction with the inter-member interval L1=160 mm, and the holder 32 was located at both ends of the coating rod 11, so that the coating rod 11 was circumferentially rotatable and constrained in its axial, upward and downward movements. The guide roll 19 was a metal roll having a surface to which hard chrome plating was applied, wherein the diameter Dg=200 mm and the width=2,200 mm. The distance La between the axial centers of the coating rod 11 and the guide roll 19 was 800 mm, which was ½ of the width W of the resin film 1. The winding angle θ of the film 1 relative to the coating rod 11 shown in FIG. 5 was θ=θ2−θ1=six degrees provided that θ1 was four degrees and θ2 was 10 degrees in the case where a relationship between the coating rod 11 and the guide roll 2 was as shown in (a), more specifically, in the case where a position of the upper surface of the guide roll 2 was lower than that of the lower surface of the coating rod 11.

The coating liquid supply unit 33 comprised the tank 15, pump 16, filter 17 and discharge head 18. A diaphragm pump (manufactured by TACMINA CORPORATION, pulsation rate: in the range of ±3.5%) was used as the pump 16, and the discharge amount was 650 g/min. A die having the slit gap of 0.1 mm and the slit width of 1,200 mm was used as the discharge head 18. A temperature of the coating liquid supply unit 33 was adjusted to 25° C. As the coating liquid 14 was used a mixture containing: 63 parts by weight (solid parts by weight) of a blended material containing dipentaerythritol hexaacrylate and dipentaerythritol pentaacrylate (product name: KAYARAD DPHA, manufactured by NIPPON KAYAKU CO., LTD.); 21 parts by weight of methylated melamine resin (product name: CYMEL 303, manufactured by Cytec Industries Inc. USA); and 16 parts by weight of ethylene oxide modified trimethylolpropane triacrylate (product name: Aronix M-350, manufactured/by TOAGOSEI CO., LTD.). The coating liquid 14 had the viscosity of 2,000 mPa·s at the temperature of 25° C. and the shear rate of 10/s.

The coating width immediately after the smoothening by the coating rod 11 was 1,400±20 mm, and the variation of the coating width stayed in an allowable range in view of a process stability. When the coating surface immediately after the smoothening by the coating rod 11 was visually observed, the generation of minor rib streaks was detected, but, bubble, streaks were not generated for two hours when 3,000 m as a product length was obtained. The thickness of the biaxially stretched multilayered film (cured film obtained from the coating liquid 14+PET film) was 130±3 μm, and the dimension of the uneven thickness was equal to that of a conventional PET film to which the coating liquid 14 was not applied. An external appearance of the multilayered film was visually observed, and the rib streaks had been leveled off to such an extent that they could not be visually confirmed, and the transverse thickness-difference lines were not visually confirmed either. Therefore, the film had such a quality that it could be shipped as a product.

Comparative Example 1

Figure 6:
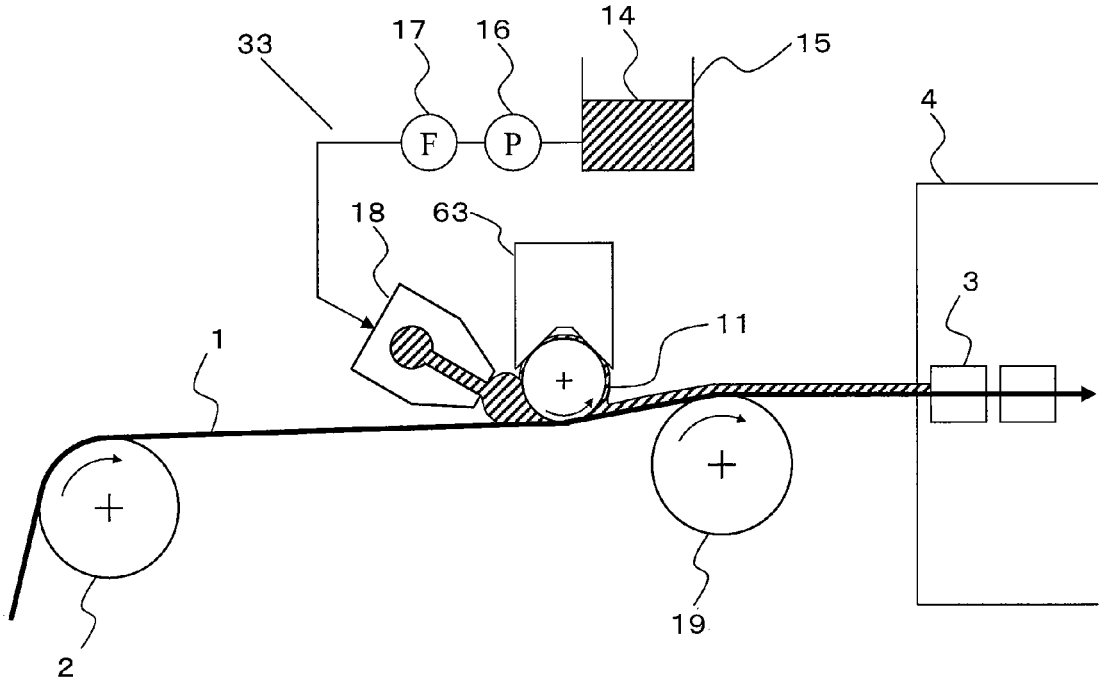
FIG. 6 is a side view of a coating apparatus wherein a groove having a V-letter shape constitutes a support member of the coating rod.

A biaxially stretched film, in which the cured film of the coating liquid 14 was formed on one surface, was obtained as in Example 1 except that the support members 63 shown in FIG. 6 were used in place of the support members 13 in Example 1. The support member 63 had a V-shape groove extending in the axial direction of the coating rod 11, and "Teflon (registered trademark)" having a good lubricating property was used as a material thereof. As a result, the rotation of the coating rod 11 was poor due to the frictional resistance between the coating rod 11 and the support member 13. An external appearance of the obtained multilayered film was visually observed, and the transverse thickness-difference lines resulting from the poor rotation of the coating rod 11 were detected. The obtained film failed to satisfy a demanded quality as a product to be shipped.

Comparative Example 2

A biaxially stretched film, in which the cured film of the coating liquid 14 was formed on one surface, was obtained as in Example 1 except that the guide roll 19 in Example 1 was not used. In this case, the liquid pool was not adequately formed immediately before the portions of the coating rod 11 and the resin film 1 contacting each other, and was discontinuous in the width direction. The coating surface had a large number of coating streaks immediately after it was smoothened by the coating rod 11, and the coating liquid 14 was missing on a part of the coating surface. Accordingly, the discharge amount of the pump 16 was increased to 800 g/min, but the state of the coating surface was riot improved. It was found from this that the resin film 1 was deflected in the width direction by the pressure of the coating liquid 14, the coating rod 11 and the resin film 1 were separated from each other, and the coating rod 11 thereby failed to smoothen the coating liquid 14 supplied from the discharge head 18. When the winding angle θ of the film 1 relative to the coating rod 11 was set to 10 degrees, the state of the coating surface was slightly improved. However, to further increase the winding angle θ would have imposed top a large burden on the coating apparatus, and also would have possibly made it impossible for the clip 3 to hold the ends of the resin film 1. Therefore, the discontinuation of the coating process was decided.

Example 2

A biaxially stretched film, in which the cured film of the coating liquid 14 was formed on one surface, was obtained as in Example 1 except that the distance La between the axial centers of the coating rod 11 and the guide roll 19 in Example 1 was set to 1,200 mm, in other words, set to be larger than ½ of the width W of the resin film 1. In this case, the liquid pool was not adequately formed immediately before the portions of the coating rod 11 and the resin film 1 contacting each other, and was discontinuous in the width direction. Further, a large number of coating streaks were detected on the coating surface.

When the discharge amount of the pump 16 was increased to 770 g/min, the liquid pool was adequately formed, and the coating streaks were no longer detected. The coating width immediately after the smoothening by the coating rod 11 was 1,400±20 mm, and the variation of the coating width stayed in an allowable range in view of the process stability. The thickness of the biaxially stretched multilayered film (cured film of the coating liquid 14+PET film) was 131±6 μm, and the dimension of the uneven thickness was deteriorated in comparison to that of the ordinary PET film to which the coating liquid 14 was not supplied. The thickness was uneven because the coating thickness at the center of the film was larger than those of the end portions. An external appearance of the multilayered film was visually observed, as a result which none of the rib streaks, bubble streaks and transverse thickness-difference lines was detected. As far as the film thus obtained is applied to purposes where the uneven thickness is allowed in a wide range, the film had such a quality that could be shipped as a product.

Example 3

The coating liquid 14 was applied to both of the upper surface and the lower surface of the resin film 1 by the coating apparatus shown in FIG. 12. The guide roll 19 in Example 1 was not used, and the lower surface of the resin film 1 was supported by the coating rod 21 instead. A wire rod where a wire made of the material SUS304 and having the diameter of 0.1 mm was wound around a round bar made of the material SUS304, diameter of D2=19 mm, and width of 1,900 mm (manufactured by Kano Shoji Co., Ltd.) so that a groove was formed was used as the second coating rod 21. The distance Lb between the axial centers of the coating rod H and the second rod 21 was set to 100 mm. In the roller 22, thermoplastic polyurethane elastomer having the thickness of 2.5 mm and the degree of hardness of 90 A was bonded to a surface of an aluminum pipe member having the diameter of 17 mm and the width of 14 mm. In the support member 23, two rollers 22 were horizontally disposed with the distance between axial centers thereof=24 mm, and the rollers 22 were circumferentially rotatable and constrained in their axial, upward and downward movements. In the support unit 41 shown in FIG. 4, eight support members 23 were spaced with the inter-member interval=200 mm in the length direction, the holder 42 was located at both ends of the second coating rod 21, and the coating rod 21 was circumferentially rotatable and constrained in its axial, upward and downward movements. The second coating liquid supply unit 43 comprised the tank 25, pump 26, filter 27 and discharge head 28. A gear pump was used as the pump 26, and the discharge amount thereof was 15 kg/min. A fountain type having the slit gap of 0.3 mm and the slit width of 1,300 mm was used as the discharge head 28. The coating liquid 24 scraped off by the coating rod 21 was collected into the tank 25 via a liquid receiver 29 and reused. As the coating liquid 24 was used a mixture obtained when 5 parts by weight of a melamine-based crosslinking agent (liquid obtained by diluting imino group type methylated melamine with a mixed solvent containing 10% by weight of isopropyl alcohol and 90% by weight of water) and 1 part by weight of colloidal silica particles having the average diameter of 0.1 μm was added to 100 parts by weight of polyester copolymer emulsion (contained components: 90 mol % of terephthalic acid, 10 mol % of 5-sodium sulfoisophthalate, 96 mol % of ethylene glycol, 3 mol % of neopentyl glycol, 1 mol % of diethylene glycol). The viscosity of the coating liquid 24 was 2 mPa·s at the temperature of 25° C. and the shear rate of 10/s. The coating liquid 24 was dried until the width-direction stretching started in the oven of the tenter 4. The rest of the process was similar to that of Example 1, and a biaxially stretched film, in which the cured film of the coating liquid 14 was formed on one surface and a dry film of the coating liquid 24 was formed on the other surface, was obtained.

The coating width of the coating liquid 14 was 1,400±20 mm immediately after it was smoothened by the coating rod 11, and the coating width of the coating liquid 24 immediately after the measurement by the coating rod 21 was 142±50 mm. Thus, the variation of the coating width stayed in ah allowable range in view of the process stability. When the coating surface coated with the coating liquid 14 immediately after the smoothening by the coating rod 11 was visually observed, the minor rib streaks were detected, but the bubble streaks were not generated for two hours when 3,000 m as a product length was obtained. The thickness of the biaxially stretched multilayered film (cured film of the coating liquid 14+PET film+dry film of the coating liquid 24) was 130±3 μm, and the dimension of the uneven thickness was equal to that of the general PET film in which the coating liquid 24 was only applied to one surface. The external appearance of the multilayered film was visually observed, and the rib streaks had been leveled off to such an extent that they could not be visually confirmed, and the transverse thickness-difference lines were not visually detected on the coating surface of the coating liquid 14. The coating surface coated with the coating liquid 24 was equal to that of the conventional PET film in which the coating liquid 24 was only applied to one surface. Therefore, the obtained film had such a quality that it could be shipped as a product.

Example 4

A biaxially stretched film, in which the cured film of the coating liquid 14 was formed on one surface and the dry film of the coating liquid 24 was formed on the other surface, was obtained as in Example 3 except that the mixing ratio of the coating liquid 14 was changed to: 67 parts by weight (solid parts by weight) of a blended material containing dipentaerythritol hexaacrylate and dipentaerythritol pentaacrylate (product name: KAYARAD DPHA, manufactured by NIPPON KAYAKU CO., LTD.); 22 parts by weight of methylated melamine (product name: CYMEL 303, manufactured by Cytec Industries Inc.); and 11 parts by weight of ethylene oxide modified trimethylolpropane triacrylate (product name: Aronix M-350, manufactured by TOAGOSEI CO., LTD.). The viscosity of the coating liquid 14, at 25° C. and the sheaf rate of 10/s, was 2,500 mPa·s. When the coating surface coated with the coating liquid 14 immediately after it was smoothened by the coating rod 11 was visually observed, the generation of the minor rib streaks was detected. Further, the bubble streaks were generated three times for two hours when 3,000 m as a product length was obtained. An external appearance of the biaxially stretched multilayered film was visually observed, and the rib streaks had been leveled off to such an extent that they could not be visually confirmed and the transverse thickness-difference lines were not visually detected on the coating surface coated with the coating liquid 14. However, the bubble streaks were visually confirmed. Therefore, the obtained film had such a quality that it could be shipped as a product as far as a section where the bubble streaks were generated was labeled as an inferior section.

Example 5

A biaxially stretched film, in which the cured film of the coating liquid 14 was formed on one surface and the dry film of the coating liquid 24 was formed on the other surface, was obtained as in Example 3 except that the supply unit for supplying the coating liquid 14 was heated to 55° C. The viscosity of the coating liquid 14 was 200 mPa·s at the temperature of 55° C. and the shear rate of 10/s. When the coating surface coated with the coating liquid 14 immediately after it was smoothened by the coating rod 11 was visually confirmed, the generation of the rib streaks was not detected, and the bubble streaks were not generated for two hours when 3,000 m as a product length was obtained. An external appearance of the biaxially stretched multilayered film was visually observed, and neither of the rib streaks nor the transverse thickness-difference lines was visually detected on the coating surface coated with the coating liquid 14. Therefore, the obtained film had such a quality that it could be shipped as a product.

Example 6

A biaxially stretched film, in which the cured film of the coating liquid 14 was formed on one surface and the dry film of the coating liquid 24 was formed on the other surface, was obtained as in Example 3 except that the supply unit for supplying the coating liquid 14 was heated to 65° C. The viscosity of the coating liquid 14 was 100 mPa·s at the temperature of 65° C. and the shear rate of 10/s, and there was a variation detected in the liquid pool formed immediately before the portions of the coating rod 11 and the resin film 1 contacting with each other. When the coating surface coated with the coating liquid 14 immediately after it was smoothened by the coating rod 11 was visually observed, the generation of the rib streaks was not detected, but the bubble streaks were generated five times for two hours when 3,000 m as a product length was obtained. The thickness of the biaxially stretched multilayered film (cured film of the coating liquid 14+PET film+dry film of the coating liquid 24) was 130±4 μm, and the dimension of the uneven thickness was slightly deteriorated in comparison to that of the conventional PET film in which the coating liquid 24 was only applied to one surface. The external appearance of the biaxially stretched multilayered film was visually observed, and neither of the rib streaks nor the transverse thickness-difference lines was visually detected but the bubbles streaks were visually detected on the coating surface coated with the coating liquid 14. Therefore, the obtained film had such a quality that it could be shipped as a product as far as a section where the bubble streaks were generated was labeled as an inferior section and the film was applied to purposes where the uneven thickness was allowed in a wide range.

Table 1 shows the results of Examples and Comparative Examples. In Examples 1 to 6, the coating rod 11 was circumscribed and supported by the support members 13 each comprising a pair of rollers 12, the lower surface of the resin film 1 was supported on the downstream side of the coating rod 11 and the upstream side of the tenter 4, and the coating liquid 14 was applied to the upper surface of the resin film 1. Thus, the multilayered film having such a quality that could be shipped as a product was obtained. Based on the fact that the dimension of the uneven thickness in Example 2 was larger than that of Example 1, the distance La between the axial centers of the coating rod 11 and the guide roll 19 is preferably at most the half of the width W of the resin film 1. When the second coating rod 21 is used in place of the guide roll 19, these two structural elements are substantially same in that they support the lower surface of the resin film 1. Therefore, the distance Lb between the axial centers of the coating rod 11 and the second coating rod 21 is more preferably at most the half of the width W of the resin film 1.

In comparison to Examples 3 and 5, the bubbles streaks were generated in Examples 4 and 6. Therefore, the viscosity of the coating liquid 14 is preferably 200 to 2,000 mPa·s.

TABLE 1

| | Viscosity of coating liquid 14 [mPa/s] | Support modes of coating rod 11 | Support modes of lower surface of resin film 1 placed on downstream side of coating rod 11 and upstream side of tenter 4 | Distance between coating rod 11 and guide roll 19 or second coating rod 21 [mm] | Evaluation result of obtained multi-layered films | Shippable or not shippable as product |
|---|---|---|---|---|---|---|
| Example 1 | 2000 | Support member 13 comprising roller 12 | Guide roll 19 | 800 | Good | Shippable |
| Comparative Example 1 | 2000 | Support member 63 having V-letter groove | Guide roll 19 | 800 | Transverse thickness-difference lines | Not shippable |
| Comparative Example 2 | 2000 | Support member 13 comprising roller 12 | None | — | Coating streaks | Not shippable |
| Example 2 | 2000 | Support member 13 comprising roller 12 | Guide roll 19 | 1200 | Large uneven thickness | Shippable if used for limited purposes |
| Example 3 | 2000 | Support member 13 comprising roller 12 | Second coating rod 21 | 100 | Good | Shippable |
| Example 4 | 2500 | Support member 13 comprising roller 12 | Second coating rod 21 | 100 | Bubble streaks generated three times in two hours | Shippable if streak-related section is labeled as inferior section |
| Example 5 | 200 | Support member 13 comprising roller 12 | Second coating rod 21 | 100 | Good | Shippable |
| Example 6 | 100 | Support member 13 comprising roller 12 | Second coating rod 21 | 100 | Bubble streaks generated five times in two hours | Shippable if used for limited purposes and streak-related |

TABLE 1-continued

| Viscosity of coating liquid 14 [mPa/s] | Support modes of coating rod 11 | Support modes of lower surface of resin film 1 placed on downstream side of coating rod 11 and upstream side of tenter 4 | Distance between coating rod 11 and guide roll 19 or second coating rod 21 [mm] | Evaluation result of obtained multi-layered films | Shippable or not shippable as product |
|---|---|---|---|---|---|
| | | | | and slightly larger uneven thickness | section is labeled as inferior section |

The invention claimed is:

1. A coating method for applying a coating liquid to both surfaces of a running resin film with a first coating rod and a second coating rod during a manufacturing process of the resin film, and then drying and/or curing the coating liquid in a tenter, wherein the first coating rod placed on an upper-surface side of the resin film is pressed onto and contacts the resin film in a state where the first coating rod is circumscribed and supported by support members each comprising a pair of rollers and spaced with intervals therebetween in a length direction of the first coating rod so that the first coating rod is rotated in a forward direction at a speed substantially equal to a speed of the resin film, the second coating rod being placed on a downstream side of the first coating rod, an upstream side of the tenter, and a lower-surface side of the resin film, the second coating rod supports the lower surface-side of the resin film and controls deflection between the first coating rod and the resin film and is pressed onto and contacts the resin film in a state where the second coating rod is circumscribed and supported by support members each comprising a pair of rollers and spaced with intervals therebetween in a length direction of the second coating rod so that the second coating rod is rotated in the forward direction at the speed substantially equal to the speed of the resin film, and a first coating liquid continuously measured and supplied to an upper surface of the resin film is smoothened by the first coating rod and a second coating liquid excessively supplied to a lower surface of the resin film is measured by the second coating rod, wherein grooves of the first coating rod cooperate to smoothen the first coating liquid and grooves of the second coating rod cooperate to measure the second coating liquid.

2. The coating method of claim 1, wherein a distance between axial centers of the first coating rod and the second coating rod is at least Dc+D2 and at most W/2 in which a width of the resin film is W, a diameter of the first coating rod is Dc, and a diameter of the second coating rod is D2.

3. The coating method of claim 1, wherein a coating liquid having a viscosity in the range of 200 to 2,000 mPa·s is used as the first coating liquid supplied to the upper surface of the resin film, and a coating liquid having a viscosity in the range of 1 to 50 mPa·s is used as the second coating liquid supplied to the lower surface of the resin film.

4. A manufacturing method of a resin film with a coating film, wherein polymer is extruded by an extruder, the polymer is formed into a sheet shape and used as the resin film, and the coating liquid is applied to the resin film with the coating method of claim 1, so that the coating film is formed.

5. A coating method for applying a coating liquid to both surfaces of a running resin film with a first coating rod and a second coating rod during a manufacturing process of the resin film, and then drying and/or curing the coating liquid in a tenter, the method comprising:

pressing the first coating rod against an upper-surface side of the resin film;

circumscribing and supporting the first coating rod by support members each comprising a pair of rollers and spaced with intervals therebetween in a length direction of the first coating rod;

rotating the first coating rod in a forward direction at a speed substantially equal to a speed of the resin film while the first coating rod contacts the upper-surface side of the resin film;

positioning the second coating rod on a downstream side of the first coating rod, an upstream side of the tenter, and a lower-surface side of the resin film, such that the second coating rod is pressed onto the resin film, supports the lower surface-side of the resin film, and controls deflection between the first coating rod and the resin film;

circumscribing and supporting the second coating rod by support members each comprising a pair of rollers and spaced with intervals therebetween in a length direction of the second coating rod;

rotating the second coating rod in the forward direction at a speed substantially equal to the speed of the resin film while the second coating rod contacts the lower-surface side of the resin film;

continuously measuring and supplying a first coating liquid to an upper surface of the resin film and smoothing the first coating liquid with grooves of the first coating rod; and excessively supplying a second coating liquid to a lower surface of the resin film and measuring the second coating liquid with grooves of the second coating rod.

* * * * *

UNITED STATES PATENT AND TRADEMARK OFFICE

CERTIFICATE OF CORRECTION

PATENT NO. : 8,535,763 B2
APPLICATION NO. : 12/440128
DATED : September 17, 2013
INVENTOR(S) : Inoue et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1128 days.

Signed and Sealed this
Fifteenth Day of September, 2015

Michelle K. Lee

Michelle K. Lee
*Director of the United States Patent and Trademark Office*